US005993274A

United States Patent [19]

Rising et al.

[11] Patent Number: 5,993,274

[45] Date of Patent: Nov. 30, 1999

[54] WEED GUARD SYSTEM

[76] Inventors: Craig M. Rising, 1350 Fuller Rd, Tallahassee, Fla. 32303; Robert W. Nelson, 1824 Log Ridge Trail, Tallahassee, Fla. 32312

[21] Appl. No.: 09/072,730

[22] Filed: May 4, 1998

[51] Int. Cl.[6] ..... B63H 5/125

[52] U.S. Cl. ..... 440/53; 440/71

[58] Field of Search ..... 248/640, 641, 248/642; 440/6, 49, 53, 57, 63, 71, 79, 83

[56] References Cited

U.S. PATENT DOCUMENTS

| | | | |
|---|---|---|---|
| 2,996,035 | 8/1961 | Torrey | 440/53 |
| 3,498,253 | 3/1970 | Wood | 440/53 |
| 4,013,033 | 3/1977 | Porter et al. | 115/42 |
| 4,070,984 | 1/1978 | Kappas | 115/42 |
| 4,224,893 | 9/1980 | Vollmar | 440/73 |
| 4,676,756 | 6/1987 | Rodrigue et al. | 440/53 |
| 4,678,440 | 7/1987 | Rodrigue et al. | 440/53 |
| 4,718,871 | 1/1988 | Mendelevitch | 440/71 |
| 4,925,412 | 5/1990 | Karls | 440/71 |
| 5,007,867 | 4/1991 | Kelley | 440/71 |

*Primary Examiner*—Stephen Avila
*Attorney, Agent, or Firm*—Peter Loffler

[57] ABSTRACT

A weed guard system for trolling motors comprises a bracket structure attached to the boat and capable of allowing the motor to articulate arcuately as well as vertically. A generally straight skeg extends diagonally outwardly from a motor shaft and terminates proximate the motor's propeller.

47 Claims, 4 Drawing Sheets

WEED GUARD SYSTEM

BACKGROUND OF THE INVENTION

1. Field of the Invention

The present invention relates to a weed guard system for preventing trolling motors from becoming entangled in vegetation.

2. Background of the Prior Art

Trolling motors oftentimes operate in areas of dense vegetation that subsists within the operating elevation of the motor. A motor that passes through such vegetation can become entangled in the vegetation causing the motor to cease operation. This necessitates the untangling of the motor and may also cause damage to the motor. In order to protect motors operating in areas of vegetation, weed guards for such motors have been proposed. These weed guards either deflect the weeds out of the way of the motor or outright destroy the weeds permitting smooth motor operation. U.S. Pat. No. 4,013,033 to Porter, U.S. Pat. No. 4,070,984 to Kappas, U.S. Pat. No. 4,718,871 to Mendelevitch, U.S. Pat. No. 4,925,412 to Karls, and U.S. Pat. No. 5,007,867 to Kelley are examples of such devices.

While such devices work with varying degrees of success, they tend to suffer from one or more drawbacks. Many devices are overly complex adding to the overall cost of the motor, while other devices require frequent cleaning in order to remain effective. Still other devices add drag to the system and reduce overall motor efficiency.

Therefore, there is a need in the art for a weed guard system that protects trolling motors and that overcomes the problems associated with current state of the art devices. Such a weed guard system must be of relatively simple and straightforward design and construction and must not require frequent maintenance. Such a weed guard must not unduly affect motor performance.

SUMMARY OF THE INVENTION

The weed guard system of the present invention addresses the aforementioned needs in the art. The weed guard system is a relatively simple and straight forward device that does not require undue maintenance. The weed guard system is a versatile propulsion operating system that does not unduly rob the motor of output propulsion.

The weed guard system of the present invention is comprised of a securement bracket having a top, bottom, and sides. A generally L-shaped attachment bracket is attached to the securement bracket and straddles the boat's transom. At least one bolt passes through the end leg of the attachment bracket and braces the boat's transom between the attachment bracket and the securement bracket. A mounting bracket, having a cup and a rod, passes through an opening on the top and an opening on the bottom of the securement bracket allowing the mounting bracket to rotate relative to the securement bracket. A first annular ring encompassing the rod above the top and a second annular ring below the bottom stabilize the mounting bracket in position while a pin maintains the mounting bracket within the securement bracket. A stanchion, having a part of generally coextensive and spaced apart plates, is pivotally attached to the cup. A sleeve having a hollow interior portion and a slit extending along a length of the sleeve is attached to the plates. A bolt squeezes the plates toward one another and pulls them apart from one another as desired, thereby adjusting the cross-section of the hollow interior portion. A guide rail structure is comprised of a guide bracket, having at least one elongated slot, and a generally arcuate guide rail attached thereto. A bolt passes through each slot and is threadably secured to a side of the securement bracket for permitting height adjustment of the guide rail structure relative to the side.

A shaft having a first end and a second end is secured within the sleeve with the cross-section adjusted as needed to firmly grip the shaft. A motor having a propeller operatively connected thereto is attached to the second end of the shaft. A generally straight skeg is attached to the shaft is diagonal orientation proximate the second end. A control system that controls the motor is attached to the shaft proximate the first end.

BRIEF DESCRIPTION OF THE DRAWINGS

Similar reference numerals refer to similar parts throughout the several views of the drawings.

DESCRIPTION OF THE PREFERRED EMBODIMENT

Figure 1:
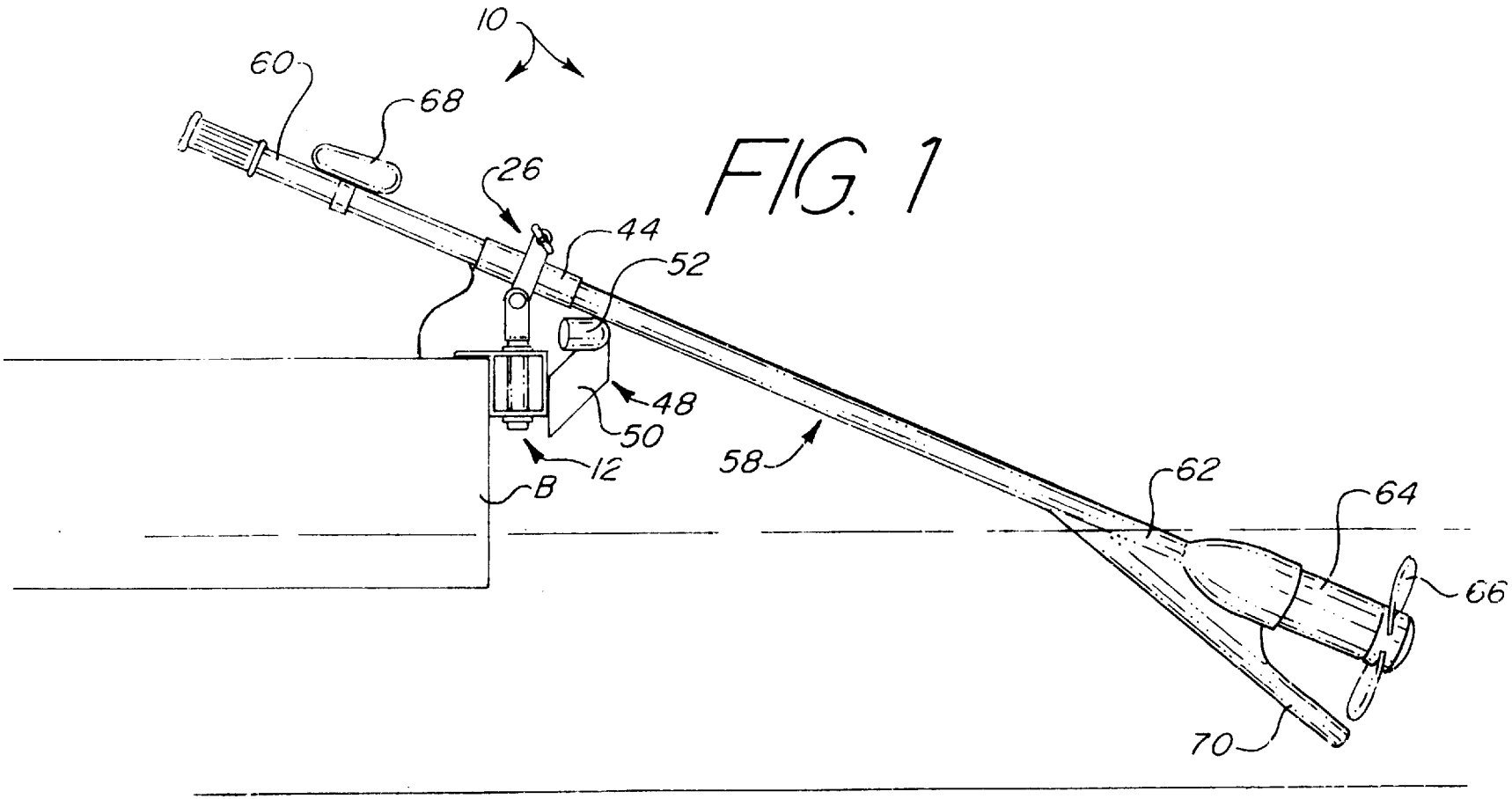
FIG. 1 is an environmental view of the weed guard system of the present invention.
Figure 3:
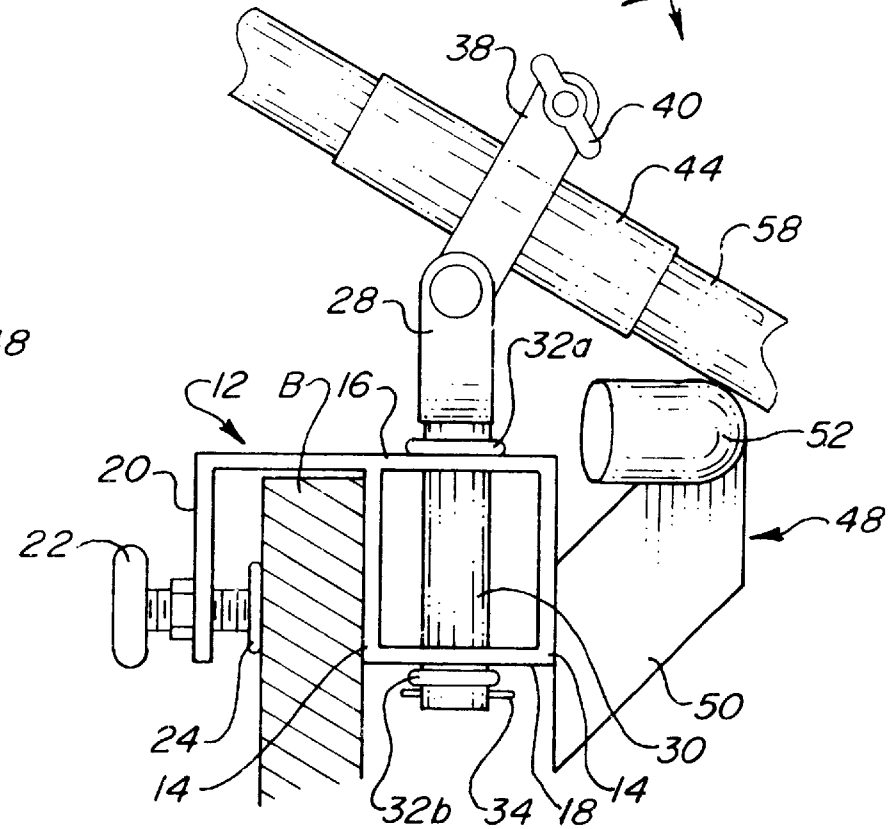
FIG. 3 is a side view of the motor mounting system with the motor extended into the water.
Figure 2:
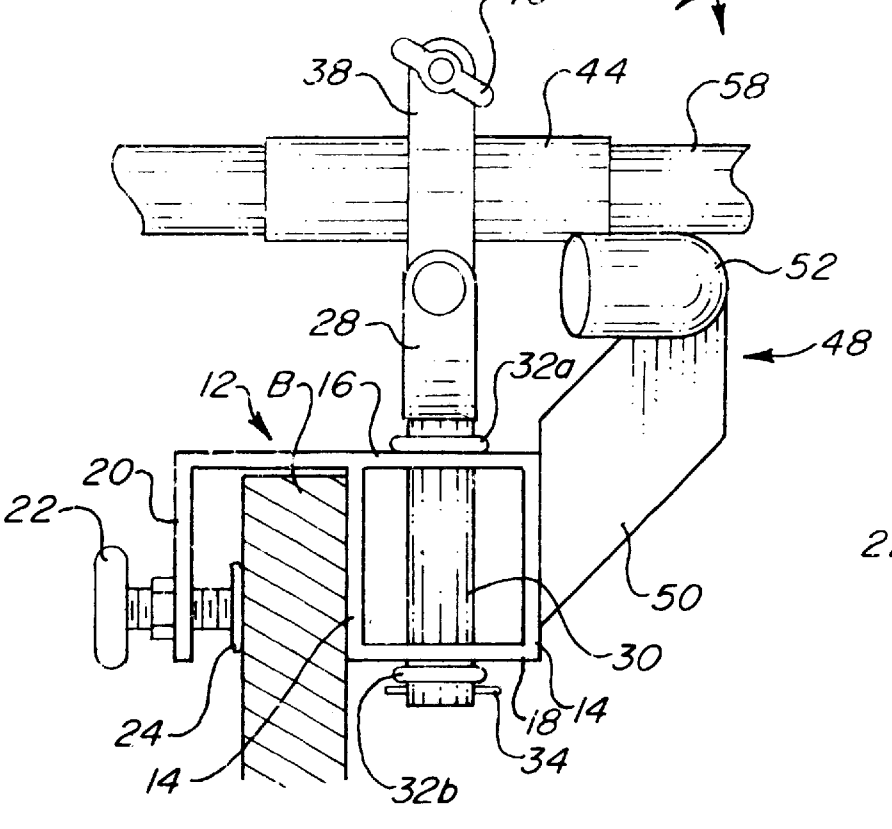
FIG. 2 is a side view of the motor mounting system with the motor retracted from the water.
Figure 4:
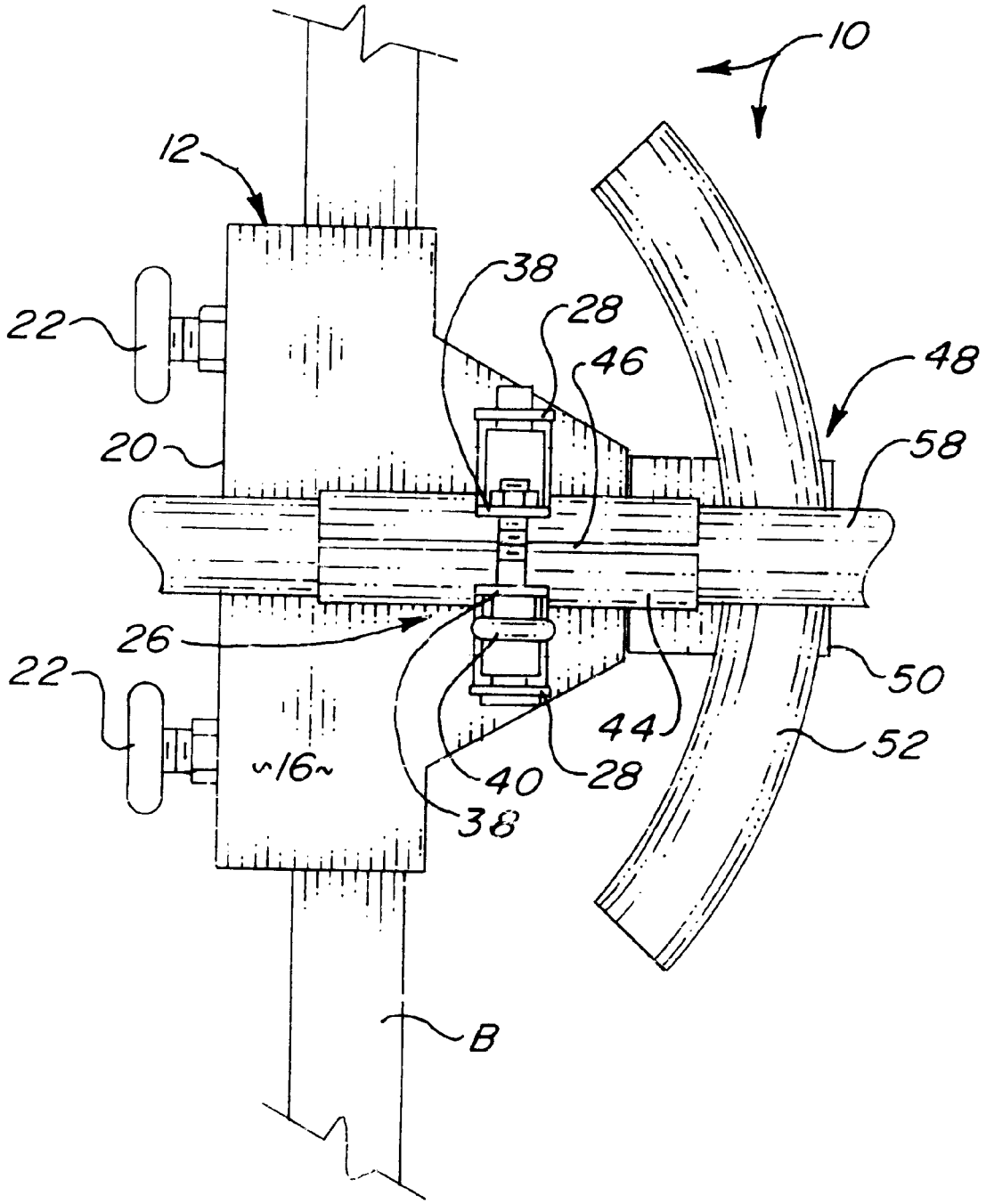
FIG. 4 is a top plan view of the motor mounting system.
Figure 5:
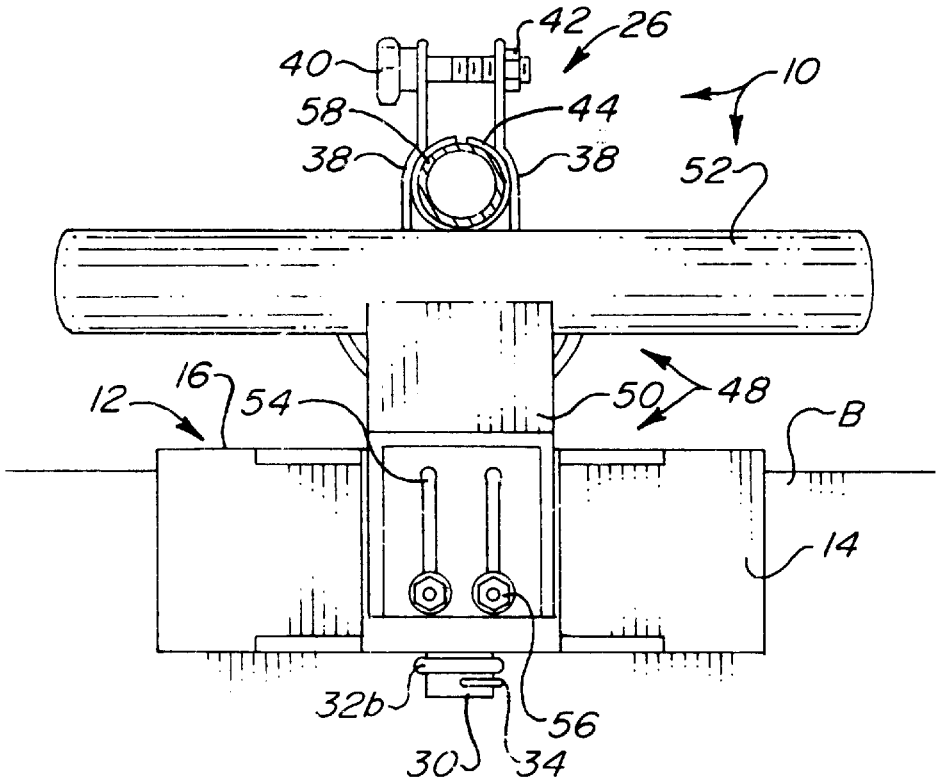
FIG. 5 is a rear elevation view of the motor mounting system.
Figure 6:
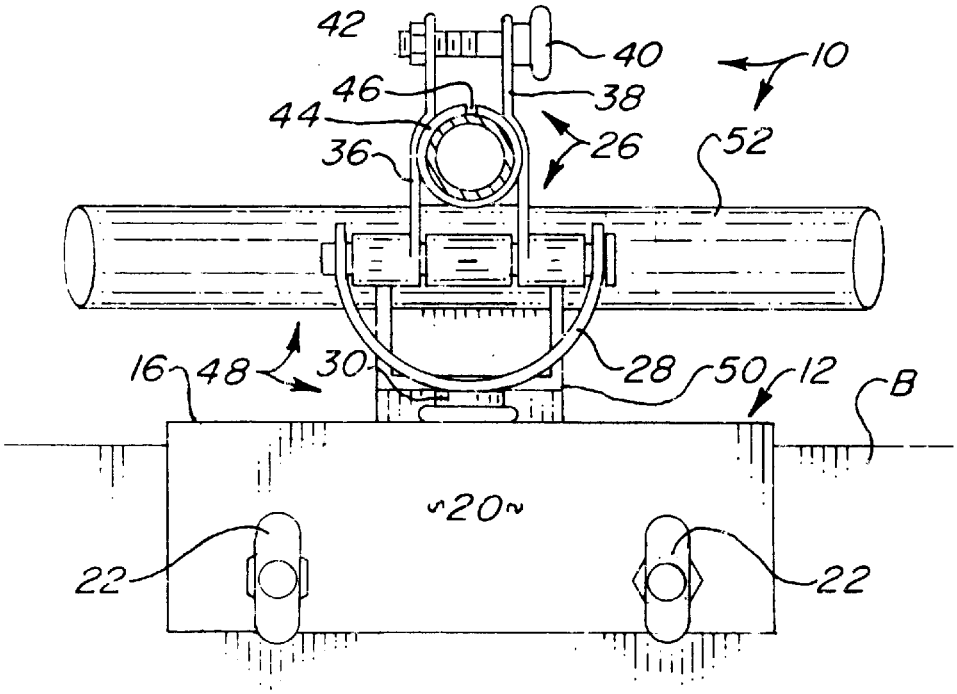
FIG. 6 is a front elevation view of the motor mounting system.

Referring now to the drawings, it is seen that the weed guard system of the present invention, generally denoted by reference numeral 10, is comprised of a motor mounting system attached to the transom of a boat B. The motor mounting system is comprised of a securement bracket 12 having a pair of sides 14, a top 16, and a bottom 18. A generally L-shaped attachment bracket 20 extends outwardly from the securement bracket 12. The securement bracket 12 is positioned such that the transom of the boat B is received between the end leg of the attachment bracket 20 and one of the sides 14 of the securement bracket 12 with the top leg of the attachment bracket 20 resting on the boat's transom. At least one and preferably a plurality of bolts 22 threadably pass through the end leg of the attachment bracket 20 and press against the transom of the boat B thereby holding the securement bracket 12 thereto. A foot 24 can be located on the end of each bolt 22 to prevent damage to the boat B. A mounting bracket 26 which has a cup 28 and a rod 30 is provided such that the rod 30 passes through an opening on the top 16 and an opening on the bottom 18 of the securement bracket 12 permitting the mounting bracket 26 to rotate relative to the securement bracket 12. A first annular ring 32*a* encompasses the rod 30 above the top 16 and prevents the mounting bracket 26 from sinking too low within the securement bracket 12 while a second annular ring 32*b* encompasses the rod 30 below the bottom 18 and prevents the mounting bracket 26 from rising too high from the securement bracket 12. At least this second annular ring 32*b* is removable. An appropriate pin 34 passes through the bottom of the rod 30 to prevent the mounting bracket 26 from being completely withdrawn from the securement bracket 12.

A stanchion 36 is pivotally secured to the cup 28. As seen, the stanchion 36 has a pair of spaced apart plates 38 and a bolt 40 threadably passing through each plate 38. A nut 42 is secured on the end of the bolt 40. A sleeve 44 having a hollow interior portion and a slit 46 extending along a length of the sleeve 44 is secured to each plate 38. The cross-section of the interior portion can be adjusted as desired. Rotation of the bolt 40 causes the plates 38 to be squeezed toward one another and thereby reduces the cross-section of the interior portion while counterrotation of the bolt 40 causes the plates 38 to be spread away from one another and thereby increases the cross-section of the interior portion.

A guide rail structure 48 is comprised of a guide bracket 50 and a guide rail 52 which has a generally arcuate shape. The guide bracket 50 has at least one elongated slot 54. At least one bolt 56 passes through each of the elongated slots 54 and is threadably received within a side 14 of the securement bracket 12. By loosening the bolts 56, the guide bracket 50 is free to move vertically along the height of the side 14. Once the desired position of the guide bracket 50 is achieved, the bolts 56 are tightened thereby holding the guide bracket 50 in place.

A propulsion system is comprised of a shaft 58 having a first end 60 and a second end 62. A motor 64 with a propeller 66 operatively connected to the motor 64, is secured to the second end 62 of the shaft 58. The motor 64, which can be electric, is controlled by a control system 68 secured to shaft 58. The control system 68 can be any control system known in the art such as the illustrated rheostat control wherein twisting of a portion of the shaft 58 adjusts the motor's output. A motor 64 reverse control will also be included.

A skeg 70 is attached to the shaft 58 proximate the second end 62 in diagonal orientation to the shaft 58. As seen, the skeg 70 is a generally straight member that terminates proximate the propeller 66.

In order to use the weed guard system 10 of the present invention, the securement bracket 12 is positioned on the outer portion of the transom of a boat B with the attachment bracket 20 used to secure the device 10 to the boat B. The shaft 58 is passed through the interior portion of the sleeve 44 and the sleeve 44 is tightened to firmly grip the shaft 58. The height of the guide rail structure 48 is adjusted as desired and the motor 64 is operated in usual fashion. Directional control of the motor 64 is achieved by simply rotating the shaft 58 as desired with the rotational attachment of the stanchion 36 to the mounting bracket 26 permitting such movement. As the motor 64 encounters vegetation, the skeg 70 pushes the vegetation downwardly until the propeller 66 has cleared the vegetation. The pivotal attachment of the stanchion 36 to the cup 28 lets the motor 64 ride upwardly in areas of very heavy vegetation. The guide rail structure 48 prevents the motor 64 from dropping too far down into the water. Furthermore, the operator can pivot the motor 64 out of the water thereby allowing the boat B to operate without propulsion without the need for idling the motor 64.

While the invention has been particularly shown and described with reference to an embodiment thereof, it will be appreciated by those skilled in the art that various changes in form and detail may be made without departing from the spirit and scope of the invention.

We claim:

1. A weed guard system comprising:

a securement bracket having a top, a bottom, and at least one side;

a guide rail structure attached to one of the at least one side;

a mounting bracket rotatably attached to the securement bracket;

a stanchion, having a pair of generally coextensive and spaced apart plates, pivotally attached to the mounting bracket;

a sleeve, having a hollow interior portion that has a cross-section, attached to the mounting bracket between the pair of plates;

a shaft having a first end and a second end disposed within the interior portion;

a motor attached to the second end;

a propeller operatively connected to the motor; and a skeg attached to the shaft in diagonal orientation proximate the second end.

2. The weed guard system as in claim 1 further comprising height adjustment means for allowing the guide rail structure to move along the height of the side.

3. The weed guard system as in claim 1 wherein the guide rail structure comprises:

a guide bracket attached to the side; and a guide rail attached to the guide bracket.

4. The weed guard system as in claim 3 further comprising:

at least one elongated slot located on the guide bracket; and at least one bolt passing through a respective one of the at least one elongated slot and threadably secured to the side.

5. The weed guard system as in claim 3 wherein the guide rail is generally arcuate in shape.

6. The weed guard system as in claim 1 further comprising adjustment means for changing the cross-section.

7. The weed guard system as in claim 6 wherein the adjustment means comprises:

a slit extending along a length of the sleeve; and a bolt threadably passing through each of the pair of plates.

8. The weed guard system as in claim 1 further comprising:

a generally L-shaped attachment bracket attached to the securement bracket; and at least one bolt threadably passing through the attachment bracket.

9. The weed guard system as in claim 8 further comprising a foot attached to the end of each of the at least one bolt.

10. The weed guard system as in claim 1 wherein the motor is electric.

11. The weed guard system as in claim 10 wherein the motor is reversible.

12. The weed guard as in claim 1 further comprising a control system attached to the shaft for controlling the functionality of the motor.

13. The weed guard system as in claim 1 wherein the skeg terminates proximate the propeller.

14. The weed guard system as in claim 13 wherein the skeg is generally straight.

15. The weed guard system as in claim 1 wherein the mounting bracket comprises:

a cup for receiving the stanchion; and a rod attached to the cup and passing through a first opening on the top and a second opening on the bottom.

16. The weed guard system as in claim 15 further comprising:

a first annular ring encompassing the rod above the top;

a second annular ring encompassing the rod below the bottom; and a pin passing through the rod proximate the second annular ring.

17. A weed guard system comprising:

a securement bracket having a top, a bottom, and at least one side;

a mounting bracket rotatably attached to the securement bracket;

a stanchion, having a pair of generally coextensive and spaced apart plates, pivotally attached to the mounting bracket;

a sleeve, having a hollow interior portion that has a cross-section, attached to the mounting bracket between the pair of plates;

a slit extending along a length of the sleeve;

a bolt threadably passing through each of the pair of plates;

a shaft having a first end and a second end disposed within the interior portion;

a motor attached to the second end;

a propeller operatively connected to the motor; and a skeg attached to the shaft in diagonal orientation proximate the second end.

18. The weed guard system as in claim 17 further comprising a guide rail structure attached to one of the at least one side.

19. The weed guard system as in claim 18 further comprising height adjustment means for allowing the guide rail structure to move along the height of the side.

20. The weed guard system as in claim 18 wherein the guide rail structure comprises:

a guide bracket attached to the side; and a guide rail attached to the guide bracket.

21. The weed guard system as in claim 20 further comprising:

at least one elongated slot located on the guide bracket; and at least one bolt passing through a respective one of the at least one elongated slot and threadably secured to the side.

22. The weed guard system as in claim 20 wherein the guide rail is generally arcuate in shape.

23. The weed guard system as in claim 17 further comprising:

a generally L-shaped attachment bracket attached to the securement bracket; and at least one bolt threadably passing through the attachment bracket.

24. The weed guard system as in claim 23 further comprising a foot attached to the end of each of the at least one bolt.

25. The weed guard system as in claim 17 wherein the motor is electric.

26. The weed guard system as in claim 25 wherein the motor is reversible.

27. The weed guard as in claim 17 further comprising a control system attached to the shaft for controlling the functionality of the motor.

28. The weed guard system as in claim 17 wherein the skeg terminates proximate the propeller.

29. The weed guard system as in claim 28 wherein the skeg is generally straight.

30. The weed guard system as in claim 17 wherein the mounting bracket comprises:

a cup for receiving the stanchion; and a rod attached to the cup and passing through a first opening on the top and a second opening on the bottom.

31. The weed guard system as in claim 30 further comprising:

a first annular ring encompassing the rod above the top;

a second annular ring encompassing the rod below the bottom; and a pin passing through the rod proximate the second annular ring.

32. A weed guard system comprising:

a securement bracket having a top, a bottom, and at least one side;

a mounting bracket rotatably attached to the securement bracket;

a stanchion, having a pair of generally coextensive and spaced apart plates, pivotally attached to the mounting bracket;

a cup for receiving the stanchion;

a rod attached to the cup and passing through a first opening on the top and a second opening on the bottom;

a sleeve, having a hollow interior portion that has a cross-section, attached to the mounting bracket between the pair of plates;

a shaft having a first end and a second end disposed within the interior portion;

a motor attached to the second end;

a propeller operatively connected to the motor; and a skeg attached to the shaft in diagonal orientation proximate the second end.

33. The weed guard system as in claim 32 further comprising a guide rail structure attached to one of the at least one side.

34. The weed guard system as in claim 33 further comprising height adjustment means for allowing the guide rail structure to move along the height of the side.

35. The weed guard system as in claim 33 wherein the guide rail structure comprises:

a guide bracket attached to the side; and a guide rail attached to the guide bracket.

36. The weed guard system as in claim 35 further comprising:

at least one elongated slot located on the guide bracket; and at least one bolt passing through a respective one of the at least one elongated slot and threadably secured to the side.

37. The weed guard system as in claim 35 wherein the guide rail is generally arcuate in shape.

38. The weed guard system as in claim 32 further comprising adjustment means for changing the cross-section.

39. The weed guard system as in claim 38 wherein the adjustment means comprises:

a slit extending along a length of the sleeve; and a bolt threadably passing through each of the pair of plates.

40. The weed guard system as in claim 32 further comprising:

a generally L-shaped attachment bracket attached to the securement bracket; and at least one bolt threadably passing through the attachment bracket.

41. The weed guard system as in claim 40 further comprising a foot attached to the end of each of the at least one bolt.

42. The weed guard system as in claim 32 wherein the motor is electric.

43. The weed guard system as in claim 42 wherein the motor is reversible.

44. The weed guard as in claim 32 further comprising a control system attached to the shaft for controlling the functionality of the motor.

45. The weed guard system as in claim 32 wherein the skeg terminates proximate the propeller.

46. The weed guard system as in claim 45 wherein the skeg is generally straight.

47. The weed guard system as in claim 32 further comprising:

a first annular ring encompassing the rod above the top;

a second annular ring encompassing the rod below the bottom; and a pin passing through the rod proximate the second annular ring.

* * * * *